US006202311B1

(12) United States Patent
Nickels, Jr.

(10) Patent No.: US 6,202,311 B1
(45) Date of Patent: Mar. 20, 2001

(54) CIRCULAR SAW WITH BEVEL ANGLE ADJUSTMENT MECHANISM

(75) Inventor: Richard C. Nickels, Jr., Hampstead, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/363,732

(22) Filed: Jul. 30, 1999

(51) Int. Cl.[7] ..... B27B 9/02
(52) U.S. Cl. ..... 30/376; 30/377
(58) Field of Search ..... 30/374, 375, 376, 30/377

(56) References Cited

U.S. PATENT DOCUMENTS

| | | | | |
|---|---|---|---|---|
| 2,543,486 | | 2/1951 | Briskin | 143/43 |
| 3,262,472 | * | 7/1966 | McCarty et al. | 30/376 |
| 3,662,796 | * | 5/1972 | Batistelli | 30/376 |
| 4,589,208 | * | 5/1986 | Iwasaki et al. | 30/376 |
| 4,856,394 | * | 8/1989 | Clowers | 30/376 |
| 4,999,916 | | 3/1991 | Sistare | 30/376 |
| 5,010,651 | | 4/1991 | Techter et al. | 30/376 |
| 5,271,155 | * | 12/1993 | Fuchs et al. | 30/376 |
| 5,433,008 | | 7/1995 | Barger, Jr. et al. | 30/376 |
| 5,452,515 | | 9/1995 | Schilling | 30/376 |
| 5,570,511 | | 11/1996 | Reich et al. | 30/376 |
| 5,881,784 | | 3/1999 | Morikawa et al. | 144/136.95 |

* cited by examiner

*Primary Examiner*—Hwei-Sui Payer
(74) *Attorney, Agent, or Firm*—Harness, Dickey & Pierce, P.L.C.

(57) ABSTRACT

The present invention provides a circular saw including a housing, a motor within the housing, a circular saw blade rotatably driven by the motor, a base and a bevel angle adjustment mechanism. The bevel angle adjustment mechanism pivotally interconnects the base to the housing such that the circular saw blade is adjustable relative to the base through a range of bevel angles. The bevel angle adjustment mechanism includes a first member carrying a detent and a second member defining a cooperating recess. The detent and the cooperating recess positively define at least one predetermined bevel angle setting.

18 Claims, 4 Drawing Sheets

CIRCULAR SAW WITH BEVEL ANGLE ADJUSTMENT MECHANISM

FIELD OF THE INVENTION

The present invention relates in general to power tools. In particular, the present invention relates to a circular saw with a bevel angle adjustment mechanism. More particularly, but without limitation to the particular embodiment shown throughout the drawings, the present invention relates to a bevel angle adjustment mechanism for a circular saw operative for positively establishing a predetermined bevel angle setting.

BACKGROUND AND SUMMARY

In portable circular saws, it is frequently desired to make tool adjustments for controlling particular aspects of a cut. For example, it is known to provide a portable circular saw with a mechanism for adjusting a depth of cut by controlling the extent to which a blade portion emerges below a base or shoe which supports the saw on a workpiece. One example of a portable circular saw constructed to include a depth of cut adjustment mechanism is shown and described in commonly assigned U.S. Pat. No. 4,982,501, which is hereby incorporated by reference as if fully set forth herein.

U.S. Pat. No. 4,982,501 discloses a portable circular saw including a depth of cut adjustment mechanism which is effected by pivoting movement between the shoe and a motoring gear case housing about a pivot connection rearward of the motor and gear case housing. Forward of the housing, an upwardly extending arcuate depth slide is fixed to the shoe. The depth slide slidably engages an arcuate depth guide carried by the motor and gear case housing. Towards the upper end of the depth slide and in generally fixed relationship to it, a clamping assembly selectively clamps the depth slide and depth guide together to establish a depth of cut adjustment setting.

It is also known to provide a portable circular saw with a bevel angle adjustment mechanism for adjusting a bevel angle of cut. One example of such a circular saw is shown and described in U.S. Pat. No. 5,452,515, which is hereby incorporated by reference. The circular saw shown in U.S. Pat. No. 5,452,515 includes a base plate, a saw blade arranged so that a bevel angle is adjustable relative to the base plate, a clamping block supported by the base plate and provided with a turning guide slot, a clamping screw extending through the turning guide slot, and supporting arm. The clamping block has a plurality of arresting pockets arranged along the turning guide slot. The clamping screw carries at least one axially spring-biased displaceable arresting sleeve which is arrestingly positionable in a respective one of the arresting pockets.

A desirable bevel angle adjustment mechanism provides for convenient, easy and speedy manipulation to set the desired bevel angle. In some applications, an operator may need to change the bevel angle setting very frequently so that an apparently minor adverse characteristic of the adjustment procedure may, in the long run, make a significant difference in operating efficiency and cost. Two significant aspects of a bevel angle adjustment mechanism are first, the ease of effecting relative movements between portions of the adjustment mechanism, and second, the accuracy and ability to set desired bevel angles.

Prior known arrangements for adjusting a saw blade relative to a base or shoe for adjusting a bevel angle of cut, including but not limited to U.S. Pat. No. 5,452,515, may operate to positively locate a saw blade relative to a base or shoe at one or more predetermined bevel angles. However, such prior known arrangements are not without their drawbacks. For example, many known arrangements are awkward to use because the user must remove and hold a lock and simultaneously adjust the saw to a desired bevel angle setting. In addition, many known arrangements cannot be offset slightly from common detented angles. For example, the arrangement disclosed by U.S. Pat. No. 5,452,515 includes a plunger which locks in a recess. If the adjustment is set slightly off from a common angle, the plunger tends to reset in the recess for the common angle. Accordingly, slight variations with such an arrangement are not possible.

The present invention comprises an improvement over prior known circular saw bevel angle adjusting systems, including those disclosed in the aforementioned patents.

In the preferred embodiment, the bevel angle adjustment mechanism of the present invention includes a mounting bracket fixed to a gear case housing of the saw and a quadrant bracket carried by the shoe. The mounting bracket is pivotally attached to the quadrant bracket to permit the shoe to be adjusted relative to the remainder of the saw and thereby adjust the bevel angle of the blade relative the shoe. A bolt is axially and nonrotatably fixed in the mounting bracket and extends through a slot in the quadrant bracket. A lever is fixed to the nut and is rotatable with the nut to clamp and unclamp the quadrant bracket relative to the mounting bracket by tightening and loosening the nut on the bolt. A selected bevel angle is indicated by an indicator extending from the mounting bracket and by a scale extending along the slot in the quadrant bracket. The adjustment mechanism has a ball detent to indicate or provide a stop for bevel angle settings (e.g. 22½° and 45° ) that are commonly used for cutting. The detent is formed by a ball (supported in the bracket) which cooperates with a series of recesses formed in a forward surface of the mounting bracket. The ball is supported in a hollow cylindrical bushing press fit into an aperture of the quadrant bracket and is spring biased toward the mounting bracket by a spring. The detent selectively cooperates with the recesses to positively define a plurality of predetermined bevel angle settings.

In one form, the present invention provides a circular saw including a housing subassembly having a motor and a circular saw blade rotatably driven by the motor. The circular saw further includes a base and a bevel angle adjustment mechanism. The bevel angle adjustment mechanism pivotally interconnects the base to the housing such that the circular saw blade is adjustable relative to the base through a range of bevel angles. The bevel angle adjustment mechanism includes a first member carrying a detent and a second member defining a cooperating recess. The detent and the cooperating recess positively define a predetermined bevel angle setting.

It is an advantage of the present invention to combine the simplicity of a conventional bevel angle adjustment mechanism with a detent to provide a user with identification of or a stop for frequently used bevel angles. The adjustment mechanism of the present invention provides the user with the choice of using the detent to provide a positive stop at the selective common angle or to override the detent and move to another common angle or a slightly offset angle.

It is another object of the present invention to provide a bevel angle adjustment mechanism which can be slightly offset from common detented angles.

It is another objective of the present invention to provide a bevel angle adjustment mechanism which includes a reduced number of parts.

BRIEF DESCRIPTION OF THE DRAWINGS

Additional objects and advantages of the present invention will become apparent from a reading of the following detailed description of the preferred embodiment which makes reference to the drawings of which.

DETAILED DESCRIPTION OF THE PREFERRED EMBODIMENT

Figure 1:
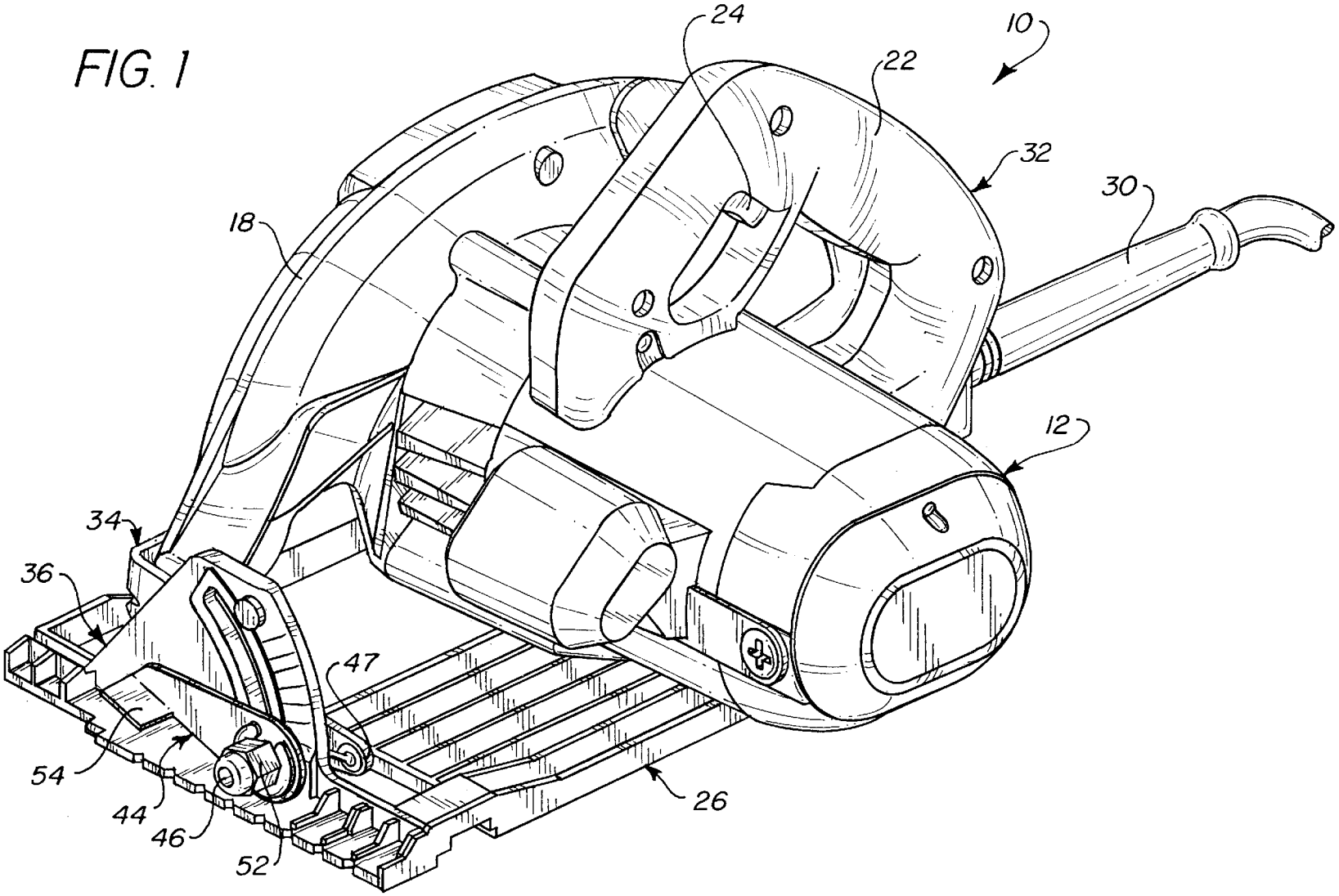
FIG. 1 is a front and left side perspective view of a circular saw constructed in accordance with the teachings of a preferred embodiment of the present invention to include a bevel angle adjustment mechanism, the bevel angle adjustment mechanism shown at a 0° bevel angle setting.
Figure 2:
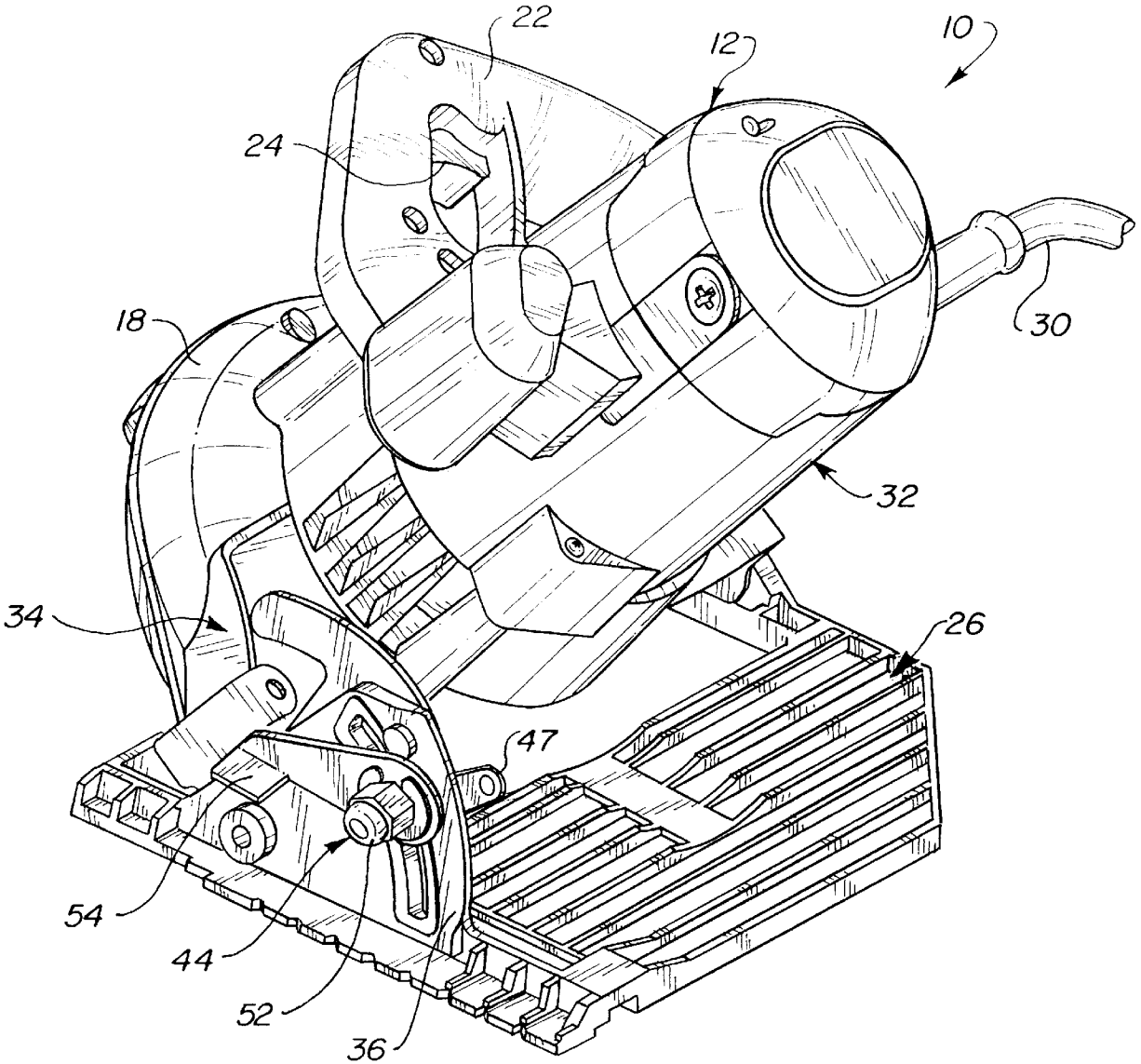
FIG. 2 is a perspective view of the circular saw of the present invention similar to FIG. 1, illustrating the bevel angle adjustment mechanism shown at a 45° bevel angle setting.

The present invention provides an improved bevel angle adjustment mechanism for a circular saw. While shown operatively associated with a particular circular saw, those skilled in the art will appreciate that the invention is not so limited in scope and is readily adaptable for use with a wide variety of circular saws.

Turning to the drawings in which identical or equivalent elements have been denoted with like reference numerals, an exemplary circular saw embodying the present invention is illustrated and identified generally at reference numeral 10. The circular saw is shown to generally include a motor and gear case housing 12 which carries a conventional saw blade 14 rotating about an axis 16. The saw blade is shielded in operation by upper and lower guards 18 and 20, respectively. As is conventional, the upper guard 18 is mounted to the housing 12. Also conventionally, the lower guard 20 is pivotally and retractably connected to the upper guard 18. A handle 22 is associated with a trigger switch 24. In operation, the saw 10 as a whole is supported on a workpiece by a base or shoe 26.

A motor 28 is disposed within the housing 12. In the exemplary embodiment illustrated, the motor 28 is conventionally powered by AC current delivered from a power cord (partially shown at 30). Alternatively, it will be understood by those skilled in the art, that the teachings of the present invention are equally applicable to battery power circular saws. An example of a battery powered circular saw which can be modified in accordance with the teachings of the present invention is illustrated and described in commonly assigned U.S. Ser. No. 09/133,923, filed Aug. 13, 1998. U.S. Ser. No. 09/133,923 is hereby incorporated by reference as if fully set forth herein.

To provide for depth of cut and bevel angle of cut adjustment, the shoe 26 is adjustably connected to the remainder of the circular saw 10. The motor and gear case housing 12, circular saw blade 14, the handle 22 and the guards 18 and 20 form an integral subassembly 32. For convenience in description, this integral subassembly will be referred to as the housing subassembly 32.

A principal component for adjustment of the depth of cut and the bevel angle of the cut is a mounting bracket 34. As will be appreciated below, the mounting bracket 34 is attached to the shoe 26 for relative pivotal movement about a first axis A. Additionally, the mounting bracket 34 is attached to the housing subassembly 32 for relative pivotal movement about a second axis B.

The present invention includes a bevel angle adjustment mechanism which generally comprises the mounting bracket 34 and an upwardly extending flange or quadrant bracket 36 carried by the shoe 26. In the exemplary embodiment illustrated, the quadrant bracket 36 is part of the shoe 26 and is integrally formed with the remainder of the shoe 26 from a die cast metal material. Alternatively, it will be understood that the quadrant bracket 36 may be independently formed and fixedly attached to the shoe 26 by a suitable means such as riveting or bolting. The mounting bracket 34 and quadrant bracket 36 are pivotally interconnected by a pin 38 which defines the first pivot axis A. The first pivot axis A is substantially parallel to an axis defined by the circular saw blade 14. The pin 38 passes through an aperture 39 provided in the bracket 34 and engages a boss portion 40 formed in the quadrant bracket 36. The quadrant bracket 36 defines an arcuate slot 42. An arcuate periphery of the quadrant bracket 36 is provided with a graduated scale or markings 45 to assist in setting a desired bevel angle. The graduated scale 45 cooperates with a pointer portion or indicator portion 47 of the mounting bracket 34.

Figure 3:
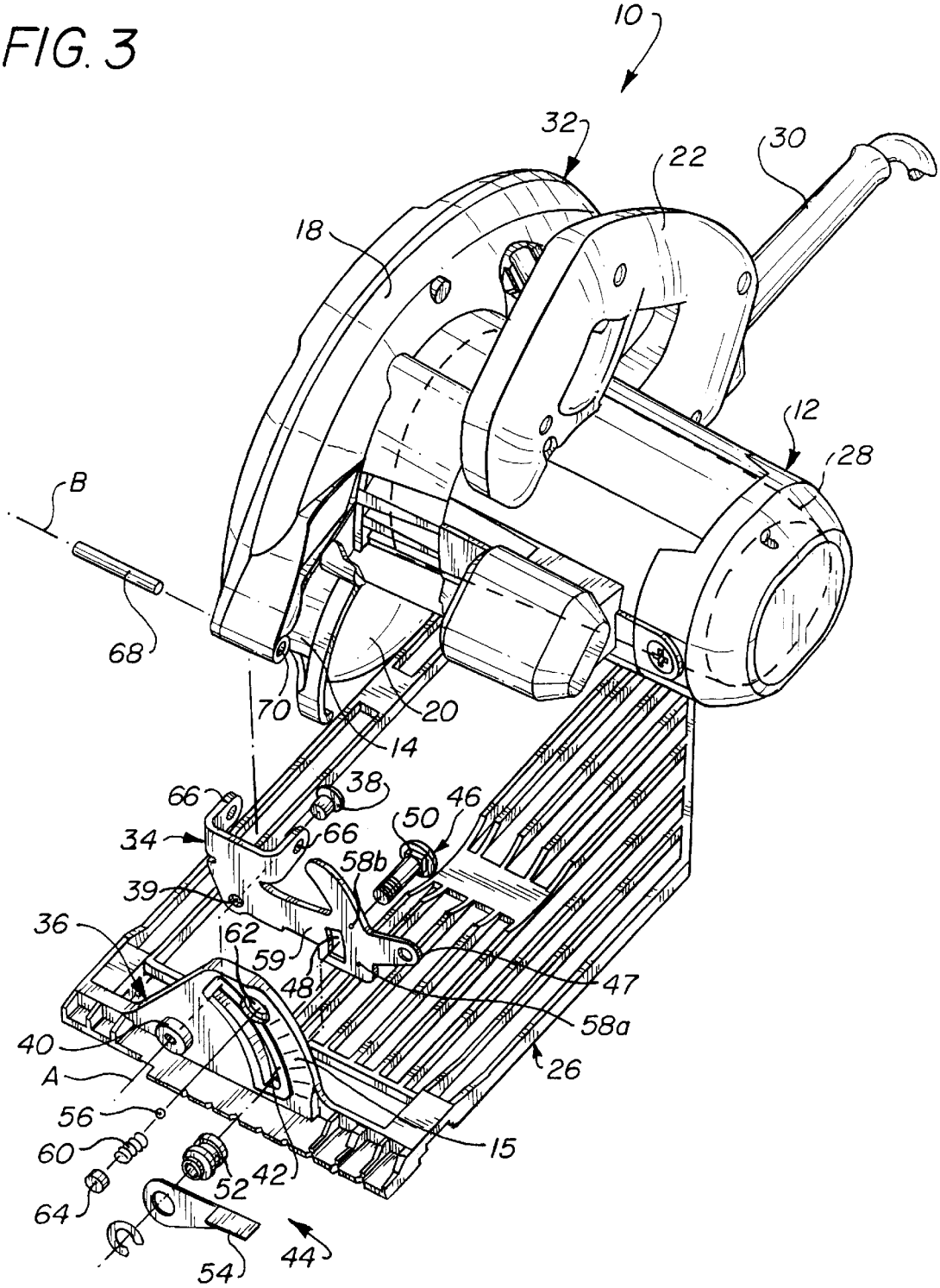
FIG. 3 is a partially exploded perspective view of the circular saw of the present invention.
Figure 4:
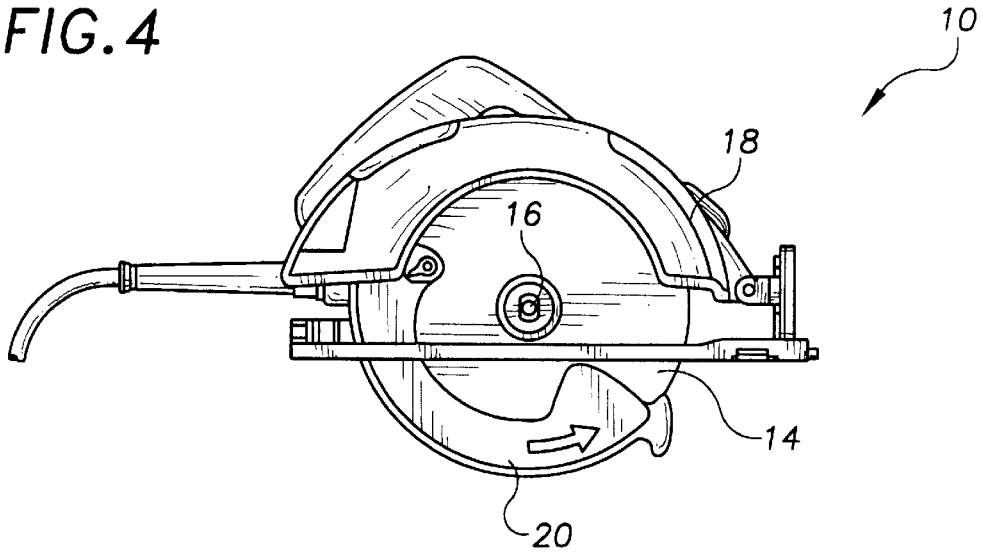
FIG. 4 is a side view of the circular saw of the present invention.
Figure 5:
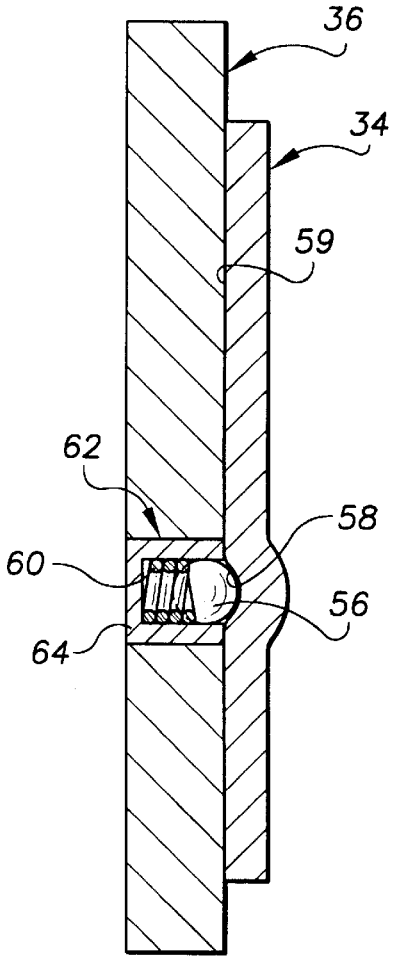
FIG. 5 is a cross-sectional view taken through the quadrant bracket and the mounting bracket at a bevel angle in which the detent of the quadrant bracket is positioned within one of the recesses of the mounting bracket.
Figure 6:
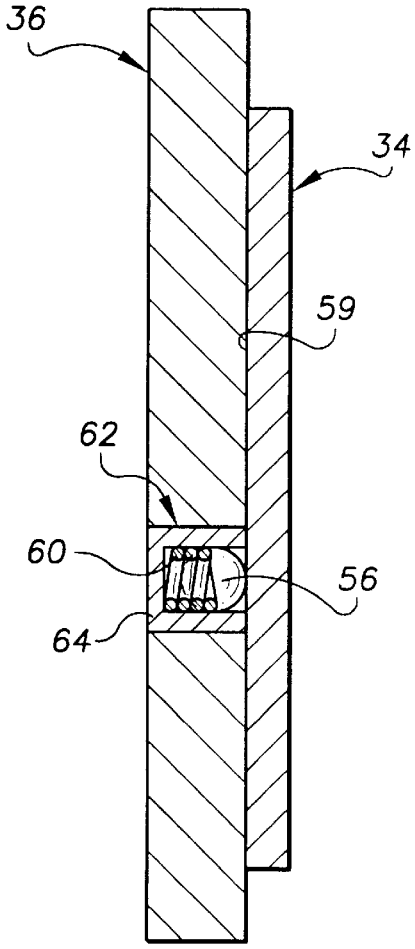
FIG. 6 is a cross-sectional view similar to FIG. 5 at a bevel angle in which the detent of the quadrant bracket is not positioned within one of the recesses of the mounting bracket.

To provide means for locking the subassembly housing 32 at a desired angular relationship relative to the base 26, the present invention includes a locking arrangement 44. The locking arrangement 44 includes a threaded bolt 46 which passes through a generally rectangular aperture 48 provided in the mounting bracket 34 and through the elongated slot 42 of the quadrant bracket 36. As best shown in the exploded view of the FIG. 3, the bolt 46 includes a squared shoulder 50 which cooperates with the sidewalls of the aperture 48 to prevent rotation of the bolt 46. The bolt 46 threadably engages a nut 52 provided on the front side of the quadrant bracket 36.

The locking arrangement further includes a manually operated lever 54 which is mounted for rotation with the bolt 46. Rotation of the lever 54 in a first direction (generally clockwise as shown in the drawings) operates to tighten the nut 52 on the bolt 46 and thereby prevent relative rotation of the mounting bracket 34 and the quadrant bracket 36. Conversely, rotation of the lever 54 in a second direction (generally counterclockwise as shown in the drawings) allows the mounting bracket 34 to rotate relative to the quadrant bracket 36.

To provide means for positively locating the shoe 26 relative to the housing subassembly 32 at at least one predetermined bevel angle setting, one of the quadrant bracket 36 and the mounting bracket 34 includes a detent 56 and the other of the quadrant bracket 36 and the mounting bracket 34 includes a recess 58. In the exemplary embodiment illustrated, the quadrant bracket 36 includes the detent in the form of a spherical ball 56 and the mounting bracket 34 includes a recess in the form of a stamped depression 58. The stamped depression 58 is formed in a forward face 59 of the bracket 34. Alternatively, it will be understood that the stamped depression 58 can be replaced with a through hole (not shown). In the exemplary embodiment, the bracket 34 is formed to include a plurality of recesses or stamped depressions 58. In one particular application, the bracket 34 includes two recesses 58. However, any number of recesses 58 may be provided depending on the desired number of predetermined bevel angles.

The spherical ball is biased toward the bracket 34 by a coil spring 60. The coil spring 60 and the spherical ball 56 are disposed within an aperture 62 defined in the quadrant bracket 36 and held therein by a hollowing bushing 64. The hollow bushing 64 is press fit into the aperture 62.

In the exemplary embodiment, a first one of the recess 58*a* provided in the bracket 34 cooperates with the spherical ball 56 to define a first predetermined bevel angle setting. Similarly, a second one of the recess 58*b* cooperates with the spherical ball 56 to define a second predetermined angle setting. In one application, the first predetermined bevel angle setting is 45° and the second predetermined bevel angle setting is 22.5°. Again, it will be understood by those skilled in the art that any number of predetermined angles can be provided for with the addition of more recesses within the bracket 34.

In the exemplary embodiment illustrated, the mounting bracket 34 includes a pair of rearwardly extending flanges 66. A pivot pin 68 passes through an aperture 70 provided in a forward portion of the upper guard 18 and through apertures provided in the rearwardly extending flanges 66. The pivot pin 68 defines the second pivot axis B and permits the housing subassembly 32 to pivot relative to the shoe 26. While not shown, it will be understood that the circular saw 10 includes a locking strap for locking the housing subassembly at a desired depth of cut setting relative to the shoe 26. One suitable locking strap is shown and described in commonly assigned U.S. Ser. No. 09/133,923, filed Aug. 13, 1998, referenced above.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A circular saw comprising:

a housing subassembly including a motor and a circular saw blade rotatably driven by the motor;

a base including a quadrant bracket; and a mounting bracket connected to the quadrant bracket for relative rotation about a first axis for establishing a bevel angle setting and connected to the housing subassembly for relative rotation about a second axis for establishing a depth of cut setting, the mounting bracket and the quadrant bracket cooperatively configured to positively locate at least one predetermined bevel angle setting;

wherein a detent is carried by one of the quadrant bracket and the mounting bracket and a cooperating recess is defined by the other of the quadrant bracket and the mounting bracket, the recess and the detent cooperating to positively define a first predetermined bevel angle setting.

2. The circular saw of claim 1, wherein the first pivot axis is substantially parallel to a plane defined by the saw blade and the second pivot axis is substantially perpendicular to the plane.

3. The circular saw of claim 2, wherein the housing subassembly includes an upper blade guard and wherein the mounting bracket is pivotally attached to the upper blade guard.

4. The circular saw of claim 1, wherein the detent is carried by the quadrant bracket and the cooperating recess is defined by the mounting bracket.

5. The circular saw of claim 4, wherein the detent is a spherical ball spring biased toward the mounting bracket.

6. The circular saw of claim 1, further comprising a locking mechanism for selectively preventing relative rotation between said mounting bracket and said quadrant bracket.

7. A circular saw comprising:

a housing subassembly including a motor and a circular saw blade rotatably driven by the motor;

a base; and a bevel angle adjustment mechanism pivotally interconnecting the base to the housing subassembly such that the circular saw blade is adjustable relative to the base through a range of bevel angles, the bevel angle adjustment mechanism including a mounting bracket attached to the housing subassembly and pivotally attached to an upwardly extending flange of the base for relative rotation about a first pivot axis, said first pivot axis being substantially parallel to a plane defined by the circular saw blade, one of the mounting bracket and the flange carrying a detent, the other of the mounting bracket and the flange defining a cooperating recess, the detent and the cooperating recess positively defining a predetermined bevel angle setting.

8. The circular saw of claim 7, wherein the mounting bracket is pivotally attached to the housing subassembly for relative movement about a second pivot axis, the second pivot axis being substantially perpendicular to the first pivot axis.

9. The circular saw of claim 7, wherein the detent comprises a spring biased ball.

10. The circular saw of claim 7, wherein the flange includes a graduated scale and the mounting bracket includes a pointer portion cooperating with the graduated scale to identify the predetermined bevel angle setting when the detent is positioned within the recess.

11. The circular saw of claim 7, further comprising a locking mechanism for selectively preventing relative rotation between said mounting bracket and said flange.

12. A circular saw comprising:

a housing subassembly including a motor and a circular saw blade rotatably driven by the motor;

a base; and a bevel angle adjustment mechanism pivotally interconnecting the base to the housing subassembly such that the circular saw blade is adjustable relative to the base through a range of bevel angles, the bevel angle adjustment mechanism including a first member carrying a detent and a second member defining a cooperating recess, the detent and the cooperating recess positively defining a predetermined bevel angle setting.

13. The circular saw of claim 12 wherein the first member and the second member are pivotally interconnected for relative rotation about a first pivot axis.

14. The circular saw of claim 13, wherein the first pivot axis is substantially parallel to a plane defined by the circular saw blade.

15. The circular saw of claim 13, wherein one of the first and second members is pivotally attached to the housing subassembly for relative movement about a second pivot axis.

16. The circular saw of claim 12, wherein the detent comprises a spring biased ball.

17. The circular saw of claim 16, wherein the first member defines a hole and wherein said bevel angle adjustment mechanism includes a hollow bushing defining a cylindrical opening, the cylindrical opening receiving a spring for biasing said ball.

18. The circular saw of claim 12, wherein one of the first and second members includes a graduate scale and the other of the first and second members including a pointer portion for cooperating with the graduated scale to identify the predetermined angle when the detent is positioned within the recess.

* * * * *